US005584275A

United States Patent [19]

Taruya

[11] Patent Number: 5,584,275

[45] Date of Patent: Dec. 17, 1996

[54] IGNITION APPARATUS FOR INTERNAL COMBUSTION ENGINE

[75] Inventor: Masaaki Taruya, Tokyo, Japan

[73] Assignee: Mitsubishi Denki Kabushiki Kaisha, Tokyo, Japan

[21] Appl. No.: 582,440

[22] Filed: Jan. 3, 1996

[30] Foreign Application Priority Data

Mar. 31, 1995 [JP] Japan ..... 7-076160

[51] Int. Cl.[6] ..... F02P 17/00

[52] U.S. Cl. ..... 123/417; 123/479; 123/609; 324/380

[58] Field of Search ..... 123/406, 417, 123/426, 479, 481, 609, 630; 324/380, 381

[56] References Cited

U.S. PATENT DOCUMENTS

| | | | |
|---|---|---|---|
| 4,301,778 | 11/1981 | Latapie | 123/426 |
| 4,366,794 | 1/1983 | Hachiga et al. | 123/479 |
| 5,199,405 | 4/1993 | Mukaihira et al. | 123/609 |
| 5,299,543 | 4/1994 | Taruya et al. | 123/479 |

FOREIGN PATENT DOCUMENTS 60-19962 2/1985 Japan .

*Primary Examiner*—Andrew M. Dolinar

*Attorney, Agent, or Firm*—Sughrue, Mion, Zinn, Macpeak & Seas

[57] ABSTRACT

An ignition apparatus for internal combustion engine capable of easily and securely sensing an ignition state based on the voltage level of an ignition signal to a power transistor includes ignition coils 13 each serving an ignition power unit 1 of the internal combustion engine, the power transistor 14 for feeding and shutting off a primary current i1 to and from the ignition coil, an ignition sensing circuit 5 for confirming that the primary current is normally fed and shut off, and a control circuit 4 including a CPU 41 for controlling fuel injection to each cylinder based on operating state signals D from various sensors 3 and outputting an ignition signal G by calculating a primary current feed time and an ignition timing of the internal combustion engine. The ignition sensing circuit includes a comparator 52 for comparing the voltage level of the ignition signal with a reference voltage level VR corresponding to a target current value of the primary current and outputs an ignition sensing signal Gd when the voltage level reaches the reference voltage level.

7 Claims, 11 Drawing Sheets

FIG. 2
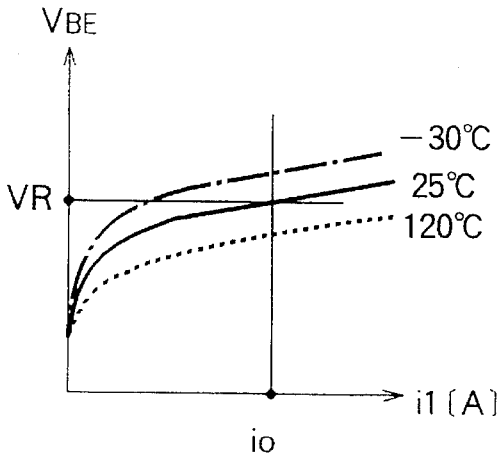
FIG. 3(a)
FIG. 3(b)
FIG. 3(c)
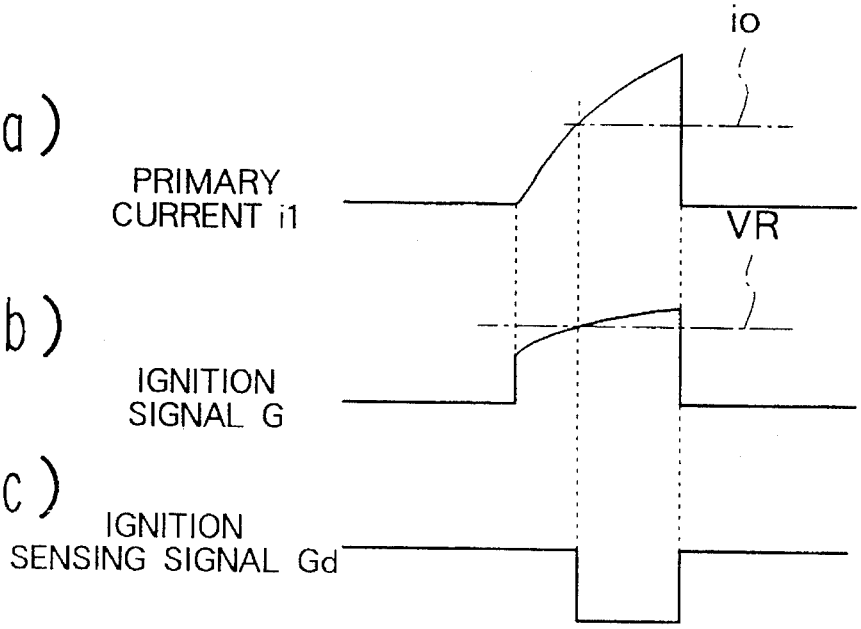

FIG. 4
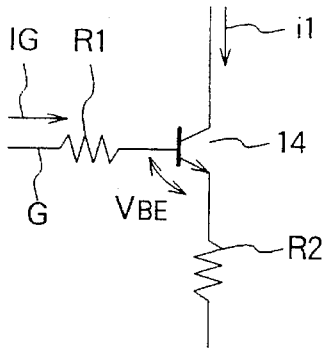
FIG. 5(a)
FIG. 5(b)
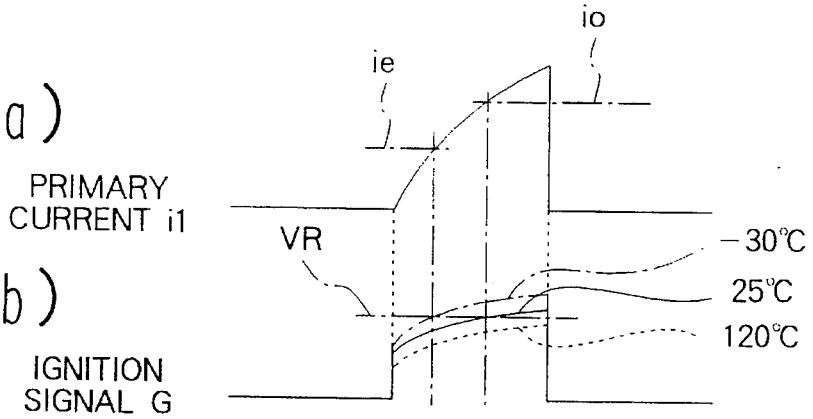
FIG. 6
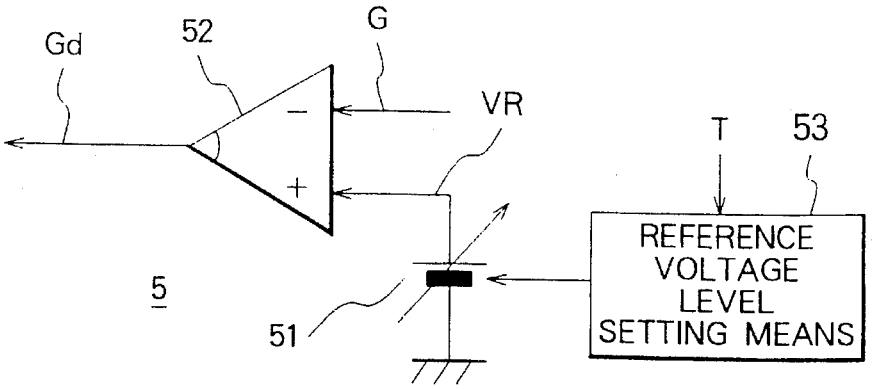

PRIMARY CURRENT i1

IGNITION SIGNAL G

IGNITION SENSING SIGNAL Gd

IGNITION SENSING SIGNAL GD io
PRIMARY CURRENT i1a io
PRIMARY CURRENT i1b

PRIMARY CURRENT i1n

OR SIGNAL GDr

IGNITION APPARATUS FOR INTERNAL COMBUSTION ENGINE

BACKGROUND OF THE INVENTION

1. Field of the Invention

The present invention relates to an ignition apparatus for internal combustion engine including an ignition sensing circuit for confirming whether ignition operation is normally carried out, and more specifically, to an ignition apparatus for internal combustion engine capable of easily and securely sensing an ignition state based on the voltage level of an ignition signal to a power transistor.

2. Description of the Related Art

Conventionally, ignition apparatuses for internal combustion engine electronically calculate and control an amount of fuel to be injected into each cylinder and an ignition timing using a microcomputer.

Further, when misfiring is caused by the faulty wiring and the like of an ignition system, fuel injection must be stopped by sensing misfiring in the ignition system so as to prevent the exhaust of uncombusted gas.

Although a method of sensing the primary voltage of an ignition coil and determining whether misfiring is caused or not is conventionally proposed as this type of an ignition sensing apparatus, it is difficult to correctly sense misfiring by such a method. A reason for it will be described with reference to FIGS. 15 (*a*) and 15 (*b*).

FIGS. 15 (*a*) and 15 (*b*) are respectively waveform diagrams showing the variation in time of the voltage level of a primary voltage, wherein FIG. 15 (*a*) shows a waveform in a normal state and FIG. 15 (*b*) shows a waveform when an abnormal state arises (for example, the voltage level drops to about one third that in the normal state due to faulty wiring and the like) respectively. In FIG. 15 (*a*), a solid line shows a waveform when the secondary side of an ignition coil is made open and a broken line shows a waveform when firing is carried out to an ignition plug connected to the secondary side, respectively.

In FIGS. 15 (*a*) and 15 (*b*), c denotes a trigger level as a comparison reference for determining whether firing is carried out normally or abnormally, and the trigger level c must determine that firing is carried out normally in the case of FIG. 15 (*a*) and that firing is carried out abnormally (i.e., misfired) in the case of FIG. 15 (*b*) according to the intrinsic object thereof.

However, since the initial value of a primary voltage is greater than the trigger level c in both the cases of FIGS. 15 (*a*) and 15 (*b*), they are determined to be in a normal firing state.

To cope with this problem, although there is proposed an ignition apparatus for internal combustion engine for determining whether misfiring is caused or not by sensing a primary current as shown for example, in Japanese Patent Publication No. 6-60626, there is a problem in the apparatus that a current sensing resistor must be provided to the passage of the primary current and thus the number of parts and circuits is increased.

As described above, the conventional ignition apparatuses for internal combustion engine have a problem that they cannot correctly determine an abnormal state when they determine the abnormal state of an ignition system based on the primary voltage of an ignition coil because even if a primary current drops to about one third that in a normal state by any reason, the primary voltage is not different from that in a normal operation.

Further, when the abnormal state of an ignition system is determined based on the primary current, a problem arises in that the number of parts is increased and thus a cost is increased because a current sensing resistor must be provided and a current sensing circuit must be connected to the resistor.

SUMMARY OF THE INVENTION

An object of the present invention made to solve the above problems is to provide an ignition apparatus for internal combustion engine capable of easily and securely sensing a firing state based on the voltage level of an ignition signal to a power transistor.

An ignition apparatus for internal combustion engine of the present invention comprises sensor means for sensing the operating state of the internal combustion engine having a plurality of cylinders and generating a corresponding output signal, an ignition power unit including ignition coils and a power transistor for controlling a primary current supplied to the ignition coils, a control circuit for calculating a primary current feed time and an ignition timing based on the outout signal from the sensor means and generating a corresponding ignition signal to the power transistor, and an ignition sensing circuit for determining whether the control on the primary current to the ignition coils is normally carried out, the ignition sensing circuit comparing the voltage level of the ignition signal with a reference voltage level corresponding to a target current value of the primary current and generating an ignition sensing signal when the voltage level of the ignition signal reaches the reference voltage level.

According to this arrangement, since the voltage level of the ignition signal is compared with the reference voltage level and the ignition sensing signal is output when the voltage level reaches the reference voltage level, ignition can be sensed by a simple arrangement.

An ignition apparatus for internal combustion engine of the present invention is arranged such that a temperature compensating resistor is connected to at least one of the base and emitter of the power transistor to offset a temperature variation in the voltage level of the ignition signal.

According to this arrangement, since the temperature variation in the voltage level of the ignition signal is offset, ignition sensing accuracy can be improved.

An ignition apparatus for internal combustion engine of the present invention is arranged such that the reference voltage level is variably set in accordance with the temperature of the ignition sensing circuit so as to accommodate the temperature variation in the voltage level.

An ignition apparatus for internal combustion engine of the present invention is arranged such that the ignition sensing circuit comprises an AND gate for providing a logical product of the ignition signal and the ignition sensing signal and outputting a corresponding final ignition sensing signal, and the control circuit feeds back the ignition signal for determining the primary current feed time and the ignition timing based on the final ignition sensing signal from the AND gate.

According to this arrangement, since the ignition signal for determining the primary current feed time and the ignition timing of the internal combustion engine is fed back based on the ignition sensing signal obtained by the logical pruduct of the ignition signal and the ignition sensing signal, power consumption can be reduced as well as the power transistor can be protected.

An ignition apparatus for internal combustion engine of the present invention is arranged such that the control circuit controls fuel injection to the cylinders based on the output signal from the sensor means, and when the ignition sensing signal cannot be obtained from the ignition sensing circuit, the control circuit stops supplying fuel to a cylinder for which the ignition sensing signal cannot be obtained.

According to this arrangement, since fuel injection to the corresponding cylinder is stopped when the ignition sensing signal cannot be obtained from the ignition sensing circuit, the exhaust of uncombusted gas can be prevented.

An ignition apparatus for internal combustion engine of the present invention is arranged such that the ignition sensing circuit is incorporated in the ignition power unit and integrally formed therewith.

According to this arrangement, since the variations in the circuit constants of the associated circuits of the power transistor is adjusted by incorporating the ignition sensing circuit in the ignition power unit, ignition sensing accuracy can be improved.

An ignition apparatus for internal combustion engine of the present invention is arranged such that the ignition sensing circuit is incorporated in the control circuit and integrally formed therewith.

According to this arrangement, since the ignition sensing circuit is incorporated in the control circuit, cost reduction can be realized by reducing the number of the externally coupled terminals.

BRIEF DESCRIPTION OF THE DRAWINGS

FIG. 2 is an ordinary characteristic graph showing the change of a base to emitter voltage of a power transistor to the primary current of an ignition coil;

FIG. 3 is a waveform diagram explaining operation of the embodiment 1 of the present invention;

FIG. 4 is a circuit diagram showing connection of temperature compensating resistors according to an embodiment 2 of the present invention;

FIG. 5 is a waveform diagram explaining operation of the embodiment 2 of the present invention;

FIG. 6 is a circuit arrangement diagram showing the main portion of an embodiment 3 of the present invention;

DESCRIPTION OF PREFERRED EMBODIMENTS

Embodiment 1

An embodiment 1 of the present invention will be described below with reference to the drawings.

Figure 1:
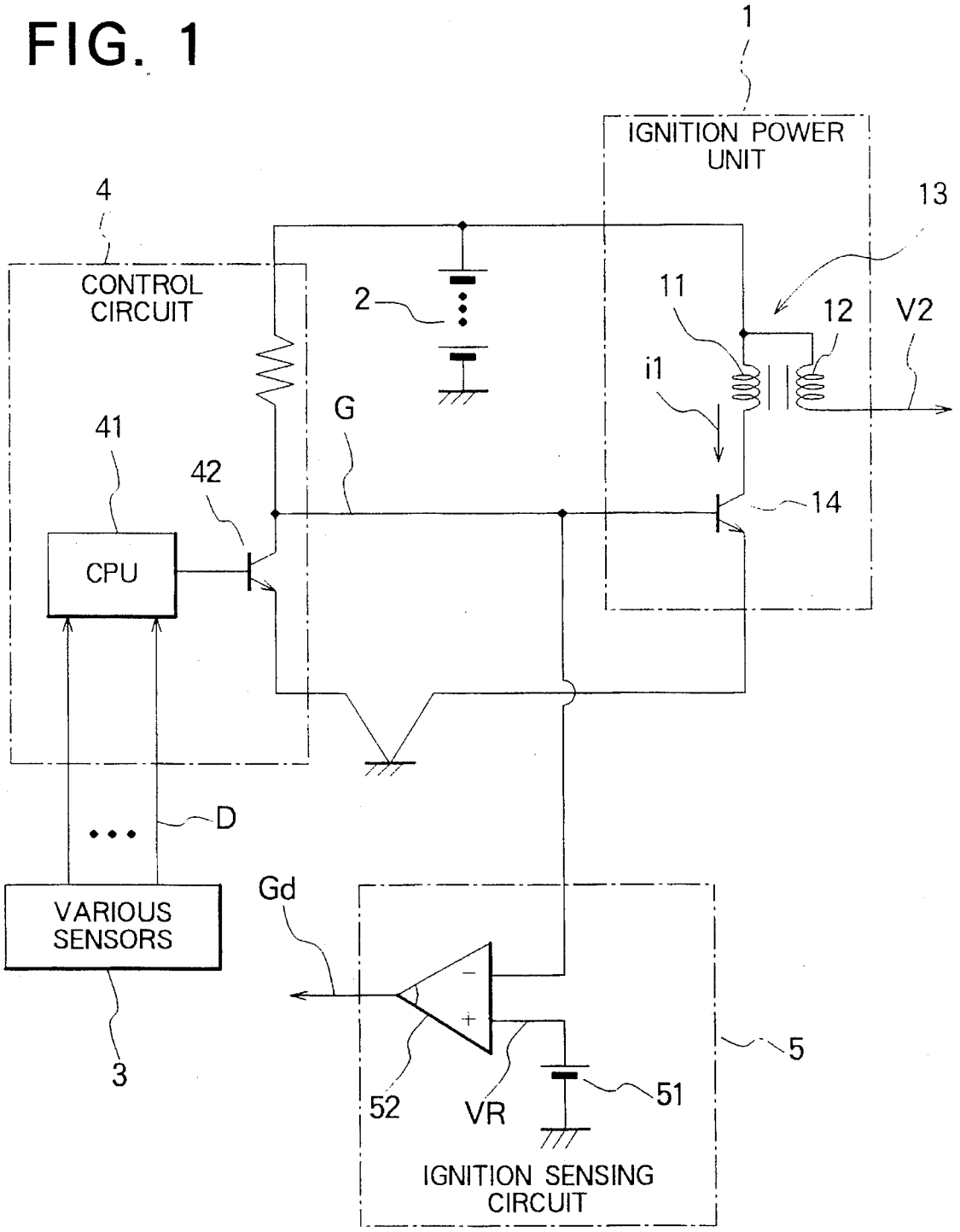
FIG. 1 is a circuit arrangement diagram showing an embodiment 1 the present invention.

FIG. 1 is a circuit arrangement diagram showing the embodiment 1 of the present invention, wherein an ignition power unit 1 includes an ignition coil 13 composed of a primary coil 11 and a secondary coil 12 and a power transistor 14 for feeding and cutting off a primary current i1 to and from the primary coil 11 and applies a high-tension secondary voltage V2 output from the secondary coil 12 to the ignition plug of each cylinder (not shown).

A power feed terminal is interconnected to the primary coil 11 and secondary coil 12 in the ignition coil 13 as a common terminal.

The power transistor 14 is composed of an emitter-grounded NPN transistor with a collector connected to the primary coil 11.

A battery 2 distributes power to the ignition apparatus as a whole including the ignition power unit 1.

Various sensors 3 outputs operating state signals D of an internal combustion engine (that is, sensing signals such as an engine r.p.m., amount of intake air, cooling water temperature, intake manifold pressure, degree of throttle opening, amount of accelerator pedal depression and the like).

A control circuit 4 includes a microcomputer in the form of a CPU 41 and an output transistor 42 for amplifying a control signal from the CPU 41. The control circuit 4 controls fuel to be injected into each cylinder based on operating state signals D from the various sensors 3 as well as calculates a time during which the primary current i1 is fed and an ignition timing of the internal combustion engine and outputs an ignition signal G to the power transistor 14. The output transistor 42 is composed of an emitter-grounded NPN transistor with a collector connected to the battery 2.

An ignition sensing circuit 5 includes a reference power unit 51 for outputting a reference voltage level VR corresponding to a target current value io of the primary current i1 and a comparator 52 for comparing the voltage level of the ignition signal G with the reference voltage level VR in order to confirm whether the primary current i1 of the ignition coil is normally fed and cut off, and output an ignition sensing signal Gd when the voltage level of the ignition signal G reaches the reference voltage level VR.

FIG. 2 is an ordinary characteristic graph showing the change of a base to emitter voltage (corresponding to the voltage level of the ignition signal G) of the power transistor 14 to the primary current i1, wherein a solid line shows a characteristic curve at an ordinary temperature (25° C.) and a dot-dash-line and a broken line show characteristic curves at a low temperature (−30° C.) and a high temperature (120° C.), respectively.

Usually, a temperature range at which the internal combustion engine is operated is set between −30° and 120° C. and the application of the ignition apparatus within this temperature range is regarded satisfactory.

FIG. 3 is a waveform diagram explaining operation of the embodiment 1 of the present invention and shows the ignition detection signal Gd relating to the change in time of the primary current i1 and ignition signal G.

Next, operation of the embodiment 1 of the present invention shown in FIG. 1 will be described with reference to FIG. 2 and FIG. 3.

First, the CPU 41 in the control circuit 4 generates a control signal for injecting fuel into each cylinder at an optimum timing in accordance with the operating state signals D from the various sensors 3 as well as outputs the ignition signal G to optimize the primary current i1 feed time and ignition timing (cut-off timing).

The power transistor 14 in the ignition power unit 1 is turned on in response to the ignition signal G at an H level and starts feeding the primary current i1 to the primary coil 11.

At the time, the voltage level of the ignition signal G is gradually increased in accordance with the characteristic curve (refer to FIG. 2) of the base to emitter voltage VBE of the power transistor 14 as shown in FIG. 3.

The comparator 52 in the ignition sensing circuit 5 outputs the ignition sensing signal Gd of a low level indicating that firing is normally carried out when the voltage level of the ignition signal G reaches the reference voltage level VR (that is, when the primary current i1 reaches the target current value io).

Note, the target current value io is a current value capable of inducing a secondary voltage V2 which securely generates a discharge spark at an ignition plug to the secondary coil 12 when the primary current i1 is cut off, and the reference power unit 51 is previously set to output the reference voltage level VR corresponding to the target current value io.

The ignition sensing signal Gd may be used as, for example, a drive signal (which indicates abnormal warning when turned to an H level) for a display unit (not shown) or reflected to the next control by being suitably fed back to the CPU 41.

As described above, the ignition sensing signal Gd can be obtained based on the voltage level of the ignition signal G corresponding to the base to emitter voltage VBE of the power transistor 14 by the provision of the ignition sensing circuit 5 alone including the comparator 52 without disposing a resistor in the passage of the primary current i1.

Therefore, a firing state can be securely sensed by a simple circuit arrangement without increasing cost.

Embodiment 2

Although no special attention is paid to the temperature characteristic of the base to emitter voltage VBE (refer to the dotted line and dot-dash-line in FIG. 2) in the embodiment 1, the reliability of the ignition sensing signal Gd may be further improved by compensating the temperature dependency of the ignition signal G.

An embodiment 2 of the present invention for temperature-compensating the ignition sensing signal Gd will be described with reference to the drawings.

FIG. 4 is a circuit diagram showing the power transistor 14 and associated components in the embodiment 2 of the present invention and temperature compensation resistors R1 and R2 are connected to the base and emitter of a power transistor 14 to compensate the temperature variation in the voltage level of the ignition signal G.

Although shown here is a case that the temperature compensation resistors R1 and R2 are respectively connected to both the base and emitter of the power transistor 14, the temperature compensation resistor R1 or R2 may be connected to at least one of the base and emitter.

Next, how the temperature characteristics of the temperature compensation resistor R1 and R2 are set in the embodiment 2 of the present invention will be specifically described with reference to the waveform diagram of FIG. 5 together with FIG. 4.

First, let us assume that the voltage value of the ignition signal G be represented by VG, the current value flowing to the base of the power transistor 14 by IG, the resistance values of the respective resistors R1 and R2 at a temperature of 25° C. by Ro1 and Ro2, and the base to emitter voltage when the primary current i1 is equal to the target current value io, the voltage value VG of the ignition signal G is expressed by the following formula (1).

$$VG=Ro1\cdot IG+Ro2\cdot io+VBEo \quad (1)$$

When differentiated by temperature T, the formula (1) is made to the following formula (2).

$$dVG/dT=(\partial VG/\partial Ro1)\cdot dRo1/dT+(\partial VG/\partial Ro2)\cdot dRo2/dT+(\partial VG/\partial VBEo)\cdot dVBEo/dT \quad (2)$$

Note, in the formula (2), it can be derived from the formula (1) that the following relationship of formula (3) is established.

$$\partial VG/\partial Ro1=IG$$

$$\partial VG/\partial Ro2=io$$

$$\partial VG/\partial VBEo=1 \quad (3)$$

When the temperature characteristics of the resistors R1 and R2 are represented by X1, X2 [ppm/cm$^2$], the temperature characteristics of the base to emitter voltage VBE is represented by X3 [V/°C.], the temperature characteristics X1 to X3 are expressed by the following formula (4).

$$X1=(1/Ro1)\cdot dRo1/dT$$

$$X2=(2/Ro2)\cdot dRo2/dT$$

$$X3=dVBEo/dT \quad (4)$$

The following formula (5) can be obtained by modifying the relationship of the formula (4).

$$dRo1/dT=Ro1\cdot X1$$

$$dRo2/dT=Ro2\cdot X2$$

$$dVBEo/dT=X3 \quad (5)$$

Therefore, the following formula (6) can be obtained by substituting the formula (5) for the formula (2) and taking the relationship of the formula (3) into consideration.

$$dVG/dT=IG\cdot Ro1\cdot X1+io\cdot Ro2\cdot X2+X3 \quad (6)$$

The respective resistance values Ro1 and Ro2 and the respective temperature characteristics of X1 to X3 need only be set to satisfy the condition of the following formula (7) in order to establish dVG/dT=0 by cancelling the temperature dependency of the voltage value VG of the ignition signal G.

$$IG\cdot Ro1\cdot X1+io\cdot Ro2\cdot X2+X3=0 \quad (7)$$

Although the formula (7) shows the case that the temperature compensation resistors R1 and R2 are connected to both the base and emitter of the power transistor 14, when a temperature compensation resistor is connected to only any one of the base and emitter, Ro1=0 or Ro2=o need only be set in the formula (7).

With the above arrangement, the voltage value VG of the ignition signal G exhibits a constant value regardless of temperature.

If the temperature compensation resistors R1 and R2 are not provided, the ignition signal G at, for example, −30° C.

is displaced as shown by a dot-dash-line in FIG. 5 with respect to the primary current i1. Therefore, the ignition signal G reaches the reference voltage level VR even if the primary current i1 has an insufficient current value ie and thus it is erroneously determined as a normal ignition state.

However, since the ignition signal G always exhibits a voltage level shown by a solid line with respect to the primary current i1 regardless of temperature by the provision of the temperature compensation resistors R1 and R2 satisfying the formula (7), the ignition signal G is regarded as indicating a normal firing state when the primary current i1 securely reaches the target current value io.

Embodiment 3

Note, although the embodiment 2 offsets the temperature dependency of the ignition signal G by the provision of the temperature compensation resistors R1 and R2, the reference voltage level VR may be variably set in accordance with temperature.

An embodiment 3 of the present invention, in which the reference voltage level VR changes in accordance with so a temperature change in the ignition signal G, will be described with reference to the drawings.

Figures 7A, 7B, 7C:
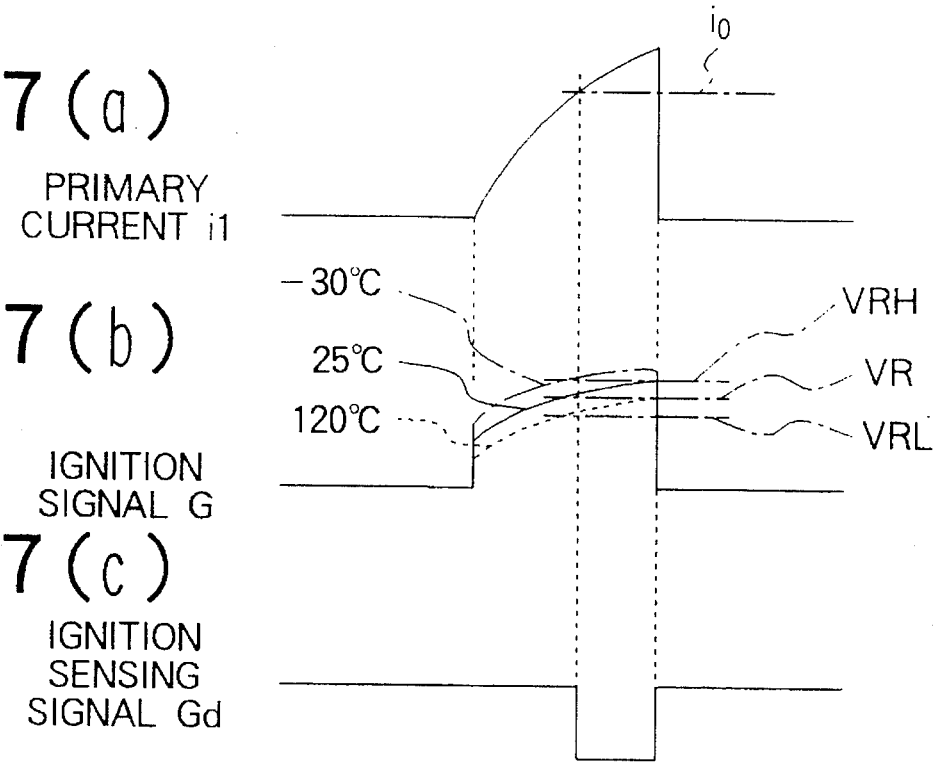
FIG. 7 is a waveform diagram explaining operation of the embodiment 3 of the present invention.

FIG. 6 is a circuit diagram showing the ignition sensing circuit 5 according to the embodiment 3 of the present invention and FIG. 7 is a waveform diagram explaining operation of the embodiment 3 of the present invention.

In FIG. 6, the reference power unit 51 is composed of a variable power unit and the reference voltage level VR is variably set under the control of a reference voltage level setting means 53.

The reference voltage level setting means 53 is disposed in the ignition sensing circuit 5 or the CPU 41 (refer to FIG. 1), and it controls the reference power unit 51 in response to a temperature T sensed by a temperature sensor included in the various sensors 3, and sets the reference voltage level VR to a value corresponding to the temperature T.

With this arrangement, reference voltage levels VR, VRL and VRH are set to the voltage levels of the ignition signal G shown at a solid line (T=25° C.), a broken line (T=−30° C.) and a dot-dash-line (T=120° C.), respectively.

That is, the reference voltage level VR is suitably set to a value between the upper limit value VRH corresponding to an allowable lower limit temperature (T=−30° C.) and the lower limit value VRL corresponding to an allowable upper limit temperature (T=120° C.).

Therefore, since the voltage level of the ignition signal G reaches the reference voltage level regardless of the temperature dependency of the ignition signal G when the primary current i1 in fact reaches the target current value io, the comparator 52 can accurately outputs the ignition sensing signal Gd indicating a normal firing state.

Although the reference power unit 51 is composed of the variable power unit and controlled by the reference voltage level setting means 53, it is also possible that, for example, the reference voltage level setting means 53 includes the function of the reference power unit 51 and directly outputs the reference voltage level VR based on map calculation and the like in accordance with the temperature T.

Embodiment 4

Further, although the above respective embodiments do not particularly describe concrete applications of the ignition sensing signal Gd, they may be applied to various types of feedback control by inputting the ignition sensing signal Gd to the CPU.

An embodiment 4 of the present invention, in which a CPU 41A carries out feedback control based on the ignition sensing signal Gd, will be described below with reference to.

Figure 8:
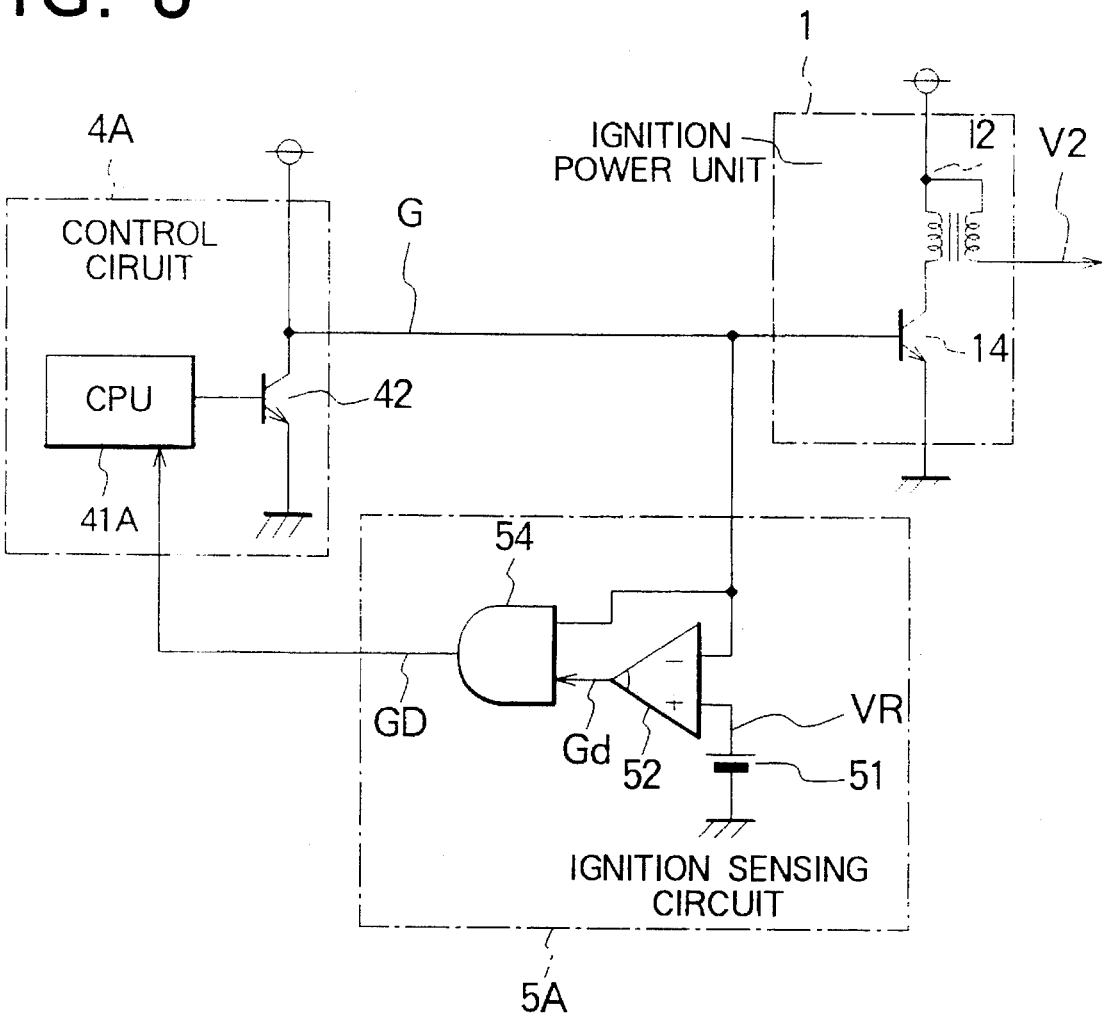
FIG. 8 is a circuit arrangement diagram showing the main portion of an embodiment 4 of the present invention.

In FIG. 8, an ignition sensing circuit 5A includes an AND gate 54 for providing a logical product of the ignition signal G and the ignition sensing signal Gd and outputting a final ignition sensing signal GD.

Further, the CPU 41A in a control circuit 4A feeds back the ignition signal G for determining the primary current i1 feed time and the ignition timing of the internal combustion engine based on the ignition signal GD from the AND gate 54.

Figures 9A, 9B, 9C, 9D:
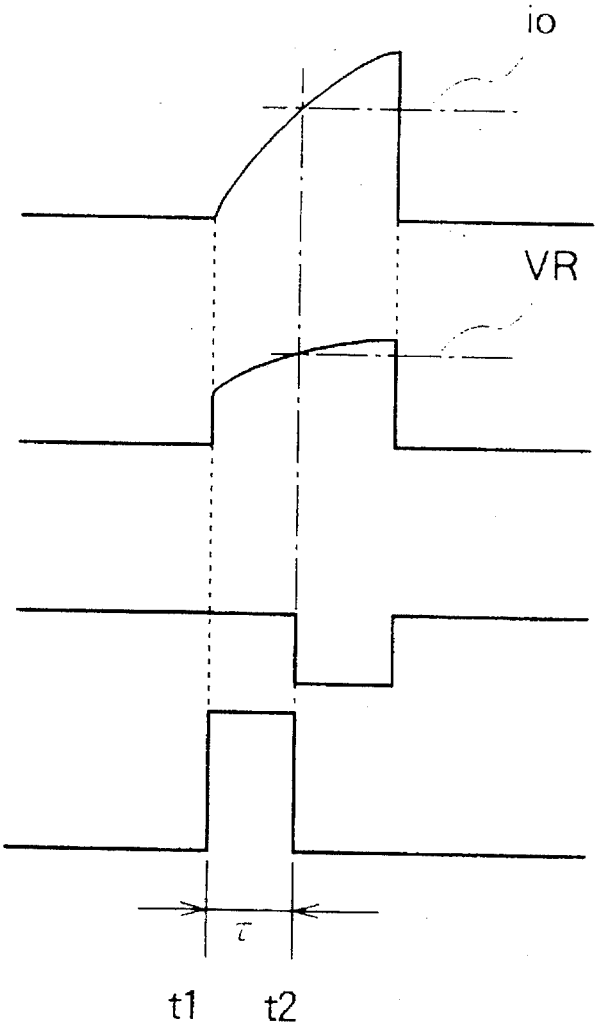
FIG. 9 is a waveform diagram explaining operation of the embodiment 4 of the present invention.

For example, it is assumed in FIG. 9 that the ignition signal G rises up at a time t1 to start feeding the primary current i1 and the voltage level of the ignition signal G reaches the reference voltage level VR (the primary current i1 reaches the target current value io) at a time t2.

At the time, since the ignition sensing signal Gd indicating the normal ignition state falls down at the time t2, the final ignition sensing signal GD, which is at the high level for the period of time from the time t1 to the time t2, is output from the AND gate 54.

The ignition sensing signal GD from the AND gate 54 is fed back to the CPU 41A and reflected to the next ignition signal G.

That is, since the period of time during which the ignition sensing signal GD is at the H level is a time during which the primary current i1 rises up and reaches the target current value io, the pulse width of the ignition signal G as the feed time of the primary current i1 need only coincide with the pulse width of the ignition sensing signal GD.

Since with this arrangement a minimum necessary feed time of the primary current i1 can be set, power consumption can be effectively reduced.

Further, damage to the power transistor 14 (refer to FIG. 1) otherwise caused by a large current can be prevented without the use of an expensive current restricting differential amplifier and the like.

Embodiment 5

Although the embodiment 4 only reflects the ignition sensing signal GD to the next ignition signal G, when the ignition sensing signal Gd output from the comparator 52 cannot be obtained and thus the ignition sensing signal GD cannot be obtained from the AND gate 54, feedback control for cutting fuel to a corresponding control cylinder may be carried out.

An embodiment 5 of the present invention for cutting fuel when the normal ignition state is not sensed will be described with reference to FIGS. 10, 11 and 12.

Figure 10:
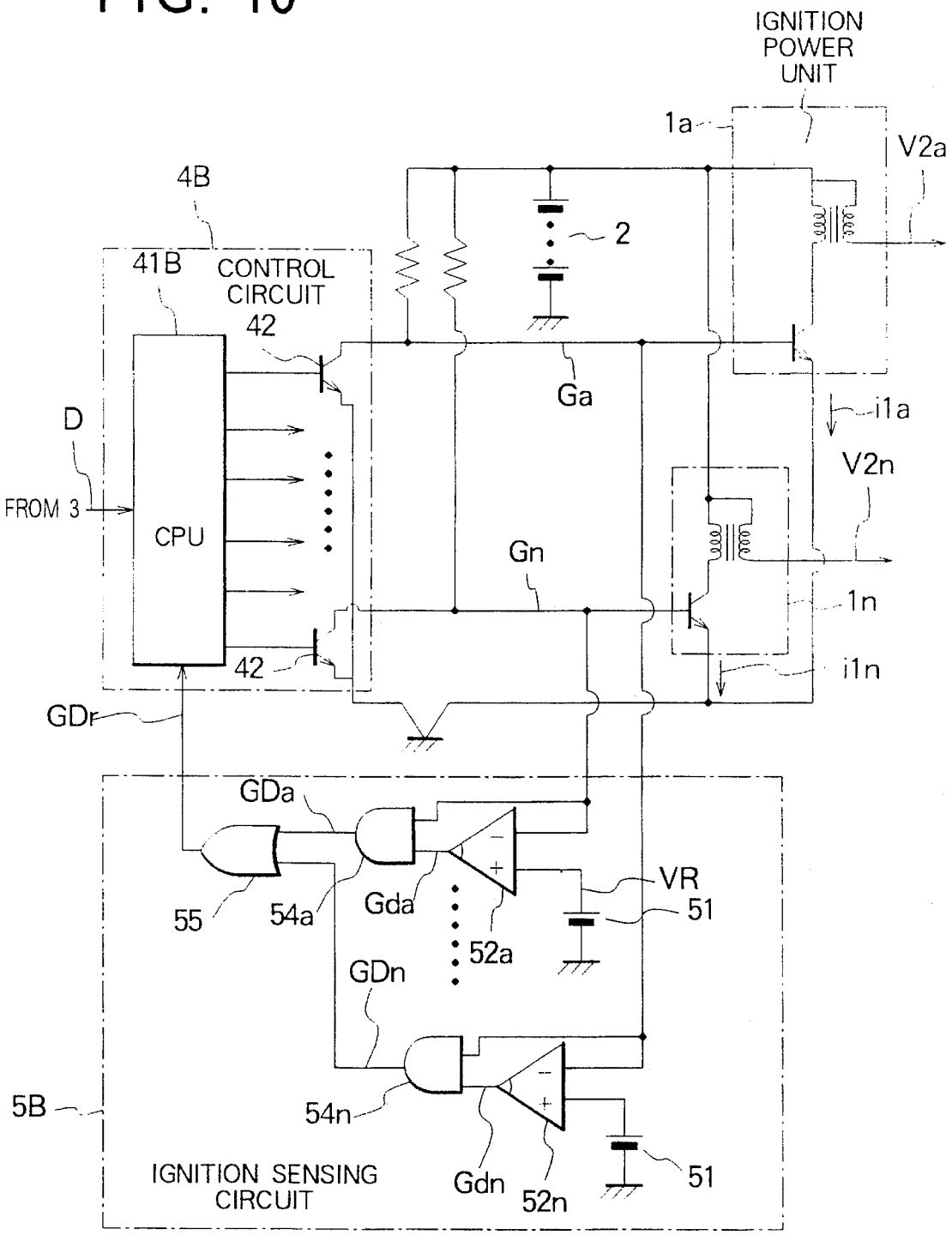
FIG. 10 is a circuit arrangement diagram showing an embodiment 5 of the present invention.

In FIG. 10, n sets of ignition power units 1*a*–1*n* are disposed in parallel with each other, one for each cylinder set of an internal combustion engine having n sets of cylinders. A control circuit 4B outputs n pieces of ignition signals G–Gn to the respective ignition power units 1*a*–1*n*.

The respective ignition power units 1*a*–1*n* individually output secondary voltages V2*a*–V2*n* to the respective cylinders.

Further, an ignition sensing circuit 5B includes n sets of comparators 52*a*–52*n* for individually comparing the voltage levels of the ignition signals Ga–Gn supplied to the respective ignition power units 1*a*–1*n*, AND gates 54*a*–54*n* arranged in parallel with the comparators for respectively providing a logical product of the ignition sensing signal Gda–Gdn from the respective comparators 52*a*–52*n* and the ignition signals Ga–Gn and an OR gate 55 for providing a logical addition of the ignition sensing signals GDa–GDn from the respective AND gates 54*a*–54*n*.

An OR signal GDr from the OR gate 55 is input to the CPU 41B in the control circuit 4B as a final ignition sensing signal.

When the ignition sensing signal (OR signal Gdr) cannot be obtained from the ignition sensing circuit 5B, the CPU 41B stops fuel injection to a cylinder to be controlled to which the ignition sensing signal cannot be obtained.

Figures 11A, 11B, 11C, 11D:
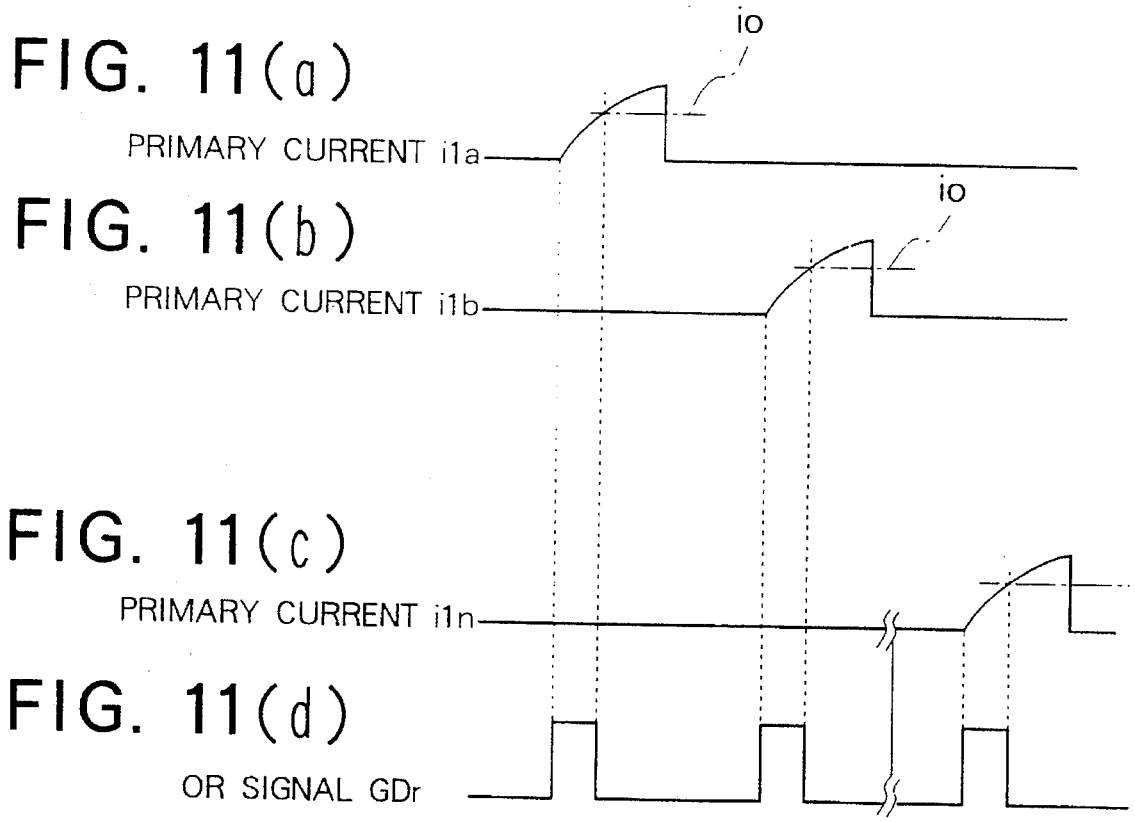
FIG. 11 a waveform diagram explaining operation of the embodiment 5 of the present invention.
Figure 12:
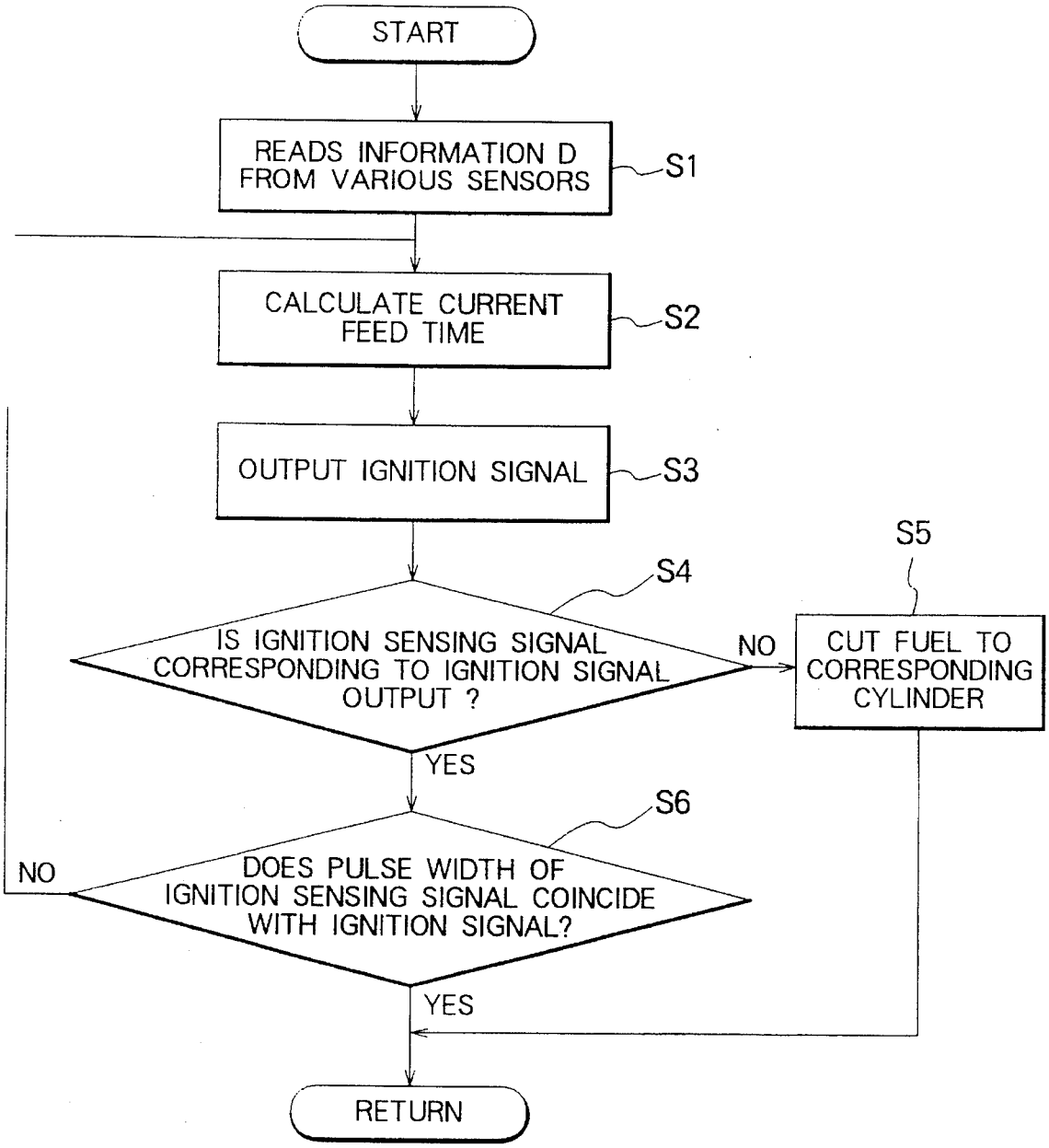
FIG. 12 is a flowchart showing fuel cut control effected by the embodiment 5 of the present invention.

FIG. 11 shows the OR signal Gdr together with the primary currents i1-i1*n* corresponding to the respective cylinders to be controlled sequentially.

For example, when the primary current i1*b* to a second cylinder to be controlled does not reach the target current value io as shown by a broken line in FIG. 11, since the OR signal with respect to the second control cylinder is not obtained, fuel cut feedback control is carried out to the second control cylinder.

With this arrangement, fuel injection to a misfiring cylinder is prohibited to thereby prevent such a disadvantage as the damage and the like of a catalyst converter which would otherwise be caused by the exhaust of uncombusted gas.

Next, the fuel cut control operation carried out by the CPU 41B of the embodiment 5 of the present invention will be described in more detail with reference to the flowchart of FIG. 12.

First, the operating state signals D are read from the various sensors 3 (step S1), and a feed time of the primary current i1 supplied from the ignition power unit to the control cylinder is calculated by map calculation according to the operating state (step S2) so that the ignition signal G according to the feed time is output (step S3).

Subsequent to the above steps, it is determined whether the ignition sensing signal GD is output in correspondence with the ignition signal G (step S4), and if it is determined that the ignition sensing signal GD is not output (that is, NO), it is determined that the normal ignition state is not achieved and the fuel injection to a corresponding cylinder is stopped (step S5) and the process returns.

On the other hand, if it is determined at step S4 that the ignition sensing signal GD is output (that is, YES), the corresponding normal cylinder is determined as in the normal ignition state.

Next, it is determined whether the pulse width of the ignition sensing signal GD coincides with the pulse width of the ignition signal G or not (step S6), and if it is determined that they coincide with each other (that is, YES), the process returns as it is.

On the other hand, if it is determined that the pulse width of the ignition sensing signal GD does not coincide with the pulse width of the ignition signal G (that is NO), the process returns to the current feed time calculation step S2 to correct the ignition signal G so that the pulse width of the ignition signal G coincides with the pulse width of the ignition sensing signal Gd.

With this operation, the pulse width of the ignition signal G is controlled in a required minimum amount in response to the ignition sensing signal Gd so that the power transistor 14 having a rated capacity of about several amperes can be protected. Further, when the occurrence of misfire is determined because of the OR signal GDr can be obtained, fuel injection to a misfired cylinder can be securely stopped.

Embodiment 6

Although the above respective embodiments do not particularly describe the location where the ignition sensing circuit is arranged, it may be integrally arranged, for example, in the ignition power unit including the power transistor 14.

Figure 13:
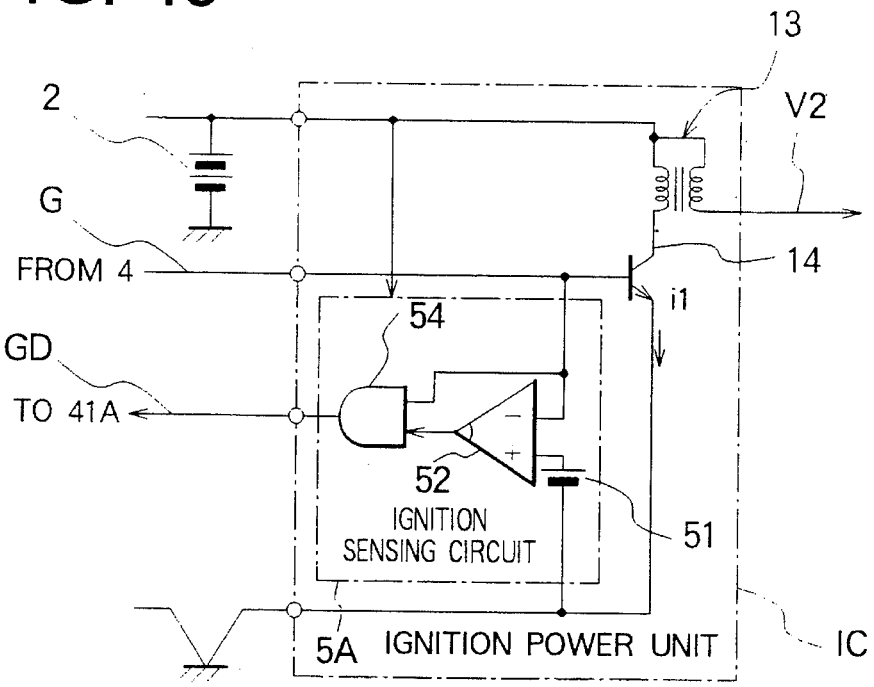
FIG. 13 is a circuit arrangement diagram showing the main portion of an embodiment 6 of the present invention.

An embodiment 6 of the present invention, in which the ignition sensing circuit is incorporated in the ignition power unit, will be described with reference to FIG. 13 which shows the main portion of the embodiment 6 of the present invention, wherein an ignition power unit 1C accommodates an ignition sensing circuit 5A integrally therewith.

Therefore, the ground terminal of the reference power unit 51 in the ignition sensing circuit 5A is directly connected to the emitter of the power transistor 14 and the comparing input terminal (–) of the comparator 52 is directly connected to the base of the power transistor 74.

The feeder line from the battery 2 to an ignition power unit 1C is also used as a feeder line to the ignition sensing circuit 5A.

The integral arrangement of the ignition sensing circuit 5A in the ignition power unit 1C permits variations in the circuit constants such as internal resistances and the like of peripheral or associated circuits of the power transistor 14 to be adjusted in the ignition sensing circuit 5A in a manufacturing process so that variations in the ignition sensing accuracy can be suppressed.

Further, the ignition sensing circuit 5A can be incorporated in the ignition power unit 1C while suppressing an increase in the number of external coupling terminals by commonly using the power feed line of the ignition power unit 1C for feeding the primary current i1 internally as a power feed line to the ignition sensing circuit 5A.

Embodiment 7

Although the ignition sensing circuit 5A is incorporated in the ignition power unit 1C in the embodiment 6, it may be arranged or formed in a control circuit integrally therewith.

An embodiment 7 of the present invention in which the ignition sensing circuit is incorporated in the control circuit will be described below with reference to FIG. 14 in which a control circuit 4C accommodates the ignition sensing circuit 5A integrally therewith.

In this case, it is assumed that variations in circuit constants of associated circuits of the power transistor 14 can be almost ignored.

Figure 14:
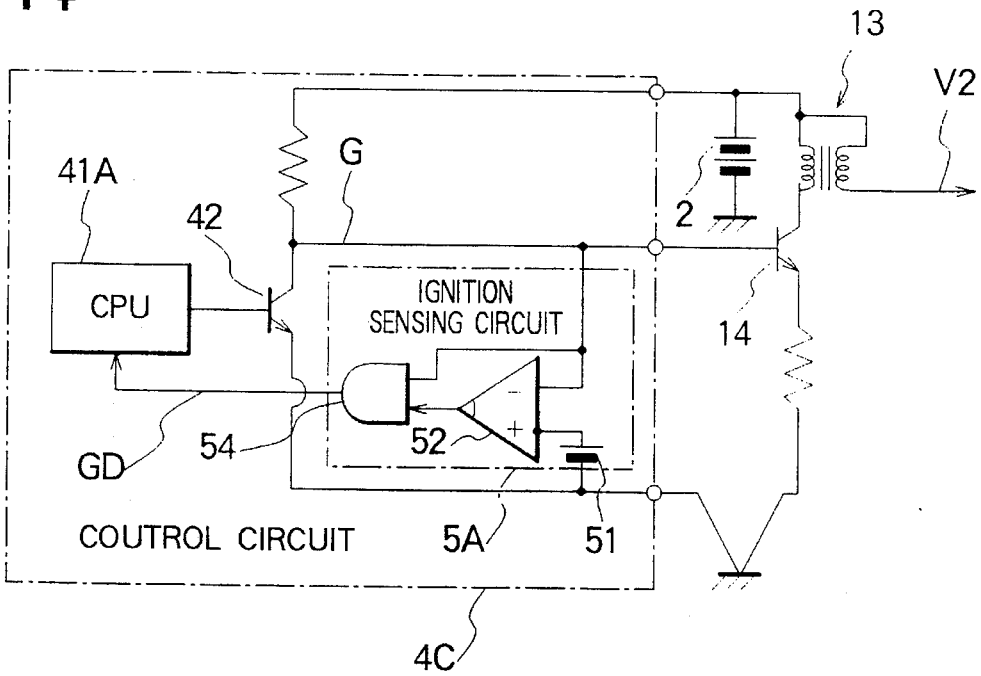
FIG. 14 is a circuit arrangement diagram showing an embodiment 7 of the present invention.
Figure 15A:
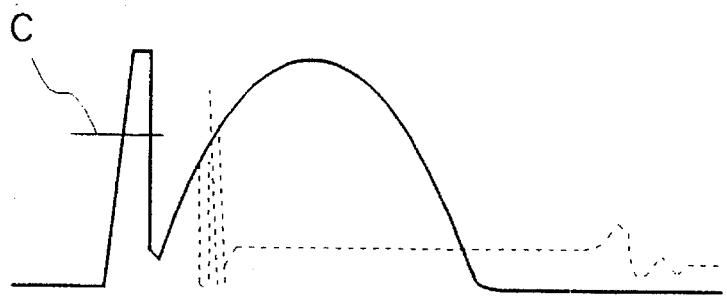
FIGS. 15 (*a*) and 15 (*b*) are respectively waveform diagrams explaining operation of a conventional ignition apparatus for internal combustion engine.
Figure 15B:
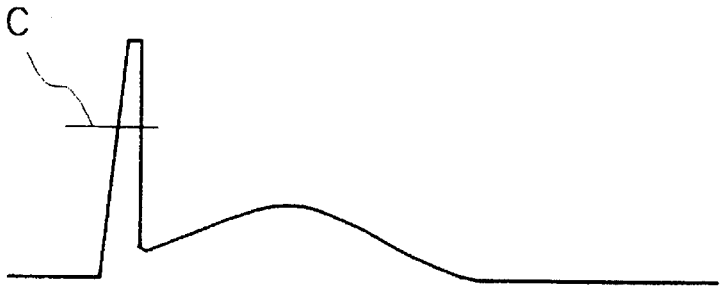

As shown in FIG. 14, since a connection line between the CPU 41A and the ignition sensing circuit 5A can be incorporated in the control circuit 4C by incorporating the ignition sensing circuit 5A in the control circuit 4C, the number of terminals at an external coupling portion can be greatly reduced and thus a manufacturing cost can be reduced.

What is claimed is:

1. An ignition apparatus for internal combustion engine comprising:

sensor means for sensing the operating state of the internal combustion engine having a plurality of cylinders and generating a corresponding output signal;

an ignition power unit including ignition coils and a power transistor for controlling a primary current supplied to said ignition coils;

a control circuit for calculating a primary current feed time and an ignition timing based on the output signal from said sensor means and generating a corresponding ignition signal to said power transistor; and an ignition sensing circuit for determining whether the control on said primary current to said ignition coils is normally carried out, said ignition sensing circuit comparing the voltage level of said ignition signal with a reference voltage level corresponding to a target current value of said primary current and generating an ignition sensing signal when the voltage level of said ignition signal reaches said reference voltage level.

2. An ignition apparatus for internal combustion engine according to claim 1, further comprising a temperature compensating resistor connected to at least one of the base and emitter of said power transistor to offset a temperature variation in the voltage level of said ignition signal.

3. An ignition apparatus for internal combustion engine according to claim 2, wherein said reference voltage level is variably set in accordance with the temperature of said ignition sensing circuit so as to accommodate the temperature variation in the voltage level.

4. An ignition apparatus for internal combustion engine according to claim 1, wherein said ignition sensing circuit comprises an AND gate for providing a logical product of said ignition signal and said ignition sensing signal and outputting a corresponding final ignition sensing signal, and said control circuit feeds back said ignition signal for determining said primary current feed time and said ignition timing based on the final ignition sensing signal from said AND gate.

5. An ignition apparatus for internal combustion engine according to claim 1, wherein said control circuit controls fuel injection to said cylinders based on the output signal from said sensor means, and when said ignition sensing signal cannot be obtained from said ignition sensing circuit, said control circuit stops supplying fuel to a cylinder for which said ignition sensing signal cannot be obtained.

6. An ignition apparatus for internal combustion engine according to claim 1, wherein said ignition sensing circuit is incorporated in said ignition power unit and integrally formed therewith.

7. An ignition apparatus for internal combustion engine according to claim 1, wherein said ignition sensing circuit is incorporated in said control circuit and integrally formed therewith.

* * * * *